US007543813B2

(12) United States Patent
Koga

(10) Patent No.: US 7,543,813 B2
(45) Date of Patent: Jun. 9, 2009

(54) SHEET FEEDING APPARATUS WITH SHEET LIFTING MEMBER AND IMAGE FORMING APPARATUS

(75) Inventor: Hiroto Koga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/435,896

(22) Filed: May 18, 2006

(65) Prior Publication Data

US 2006/0267267 A1 Nov. 30, 2006

(30) Foreign Application Priority Data

May 25, 2005 (JP) ..... 2005-152148

(51) Int. Cl.
*B65H 1/12* (2006.01)

(52) U.S. Cl. ..... 271/160; 271/171

(58) Field of Classification Search ..... 271/160, 271/171

See application file for complete search history.

(56) References Cited

U.S. PATENT DOCUMENTS 4,343,461 A 8/1982 Tomimori et al. ..... 271/22
4,501,417 A * 2/1985 Foster et al. ..... 271/124
4,874,159 A * 10/1989 Maeno et al. ..... 271/171
5,364,087 A * 11/1994 Schieck et al. ..... 271/148
5,823,525 A 10/1998 Miki ..... 271/127
6,412,772 B1 * 7/2002 Itoh et al. ..... 271/145
7,140,605 B2 11/2006 Suga et al. ..... 271/97
7,140,606 B2 11/2006 Suga et al. ..... 271/97
2005/0133980 A1 6/2005 Koga ..... 271/97

FOREIGN PATENT DOCUMENTS

JP 61-22647 6/1996
JP 9-30663 2/1997

* cited by examiner

*Primary Examiner*—Patrick H Mackey
*Assistant Examiner*—Gerald W McClain
(74) *Attorney, Agent, or Firm*—Fitzpatrick, Cella, Harper & Scinto

(57) ABSTRACT

A sheet feeding apparatus has a sheet loading plate, a sheet feeding member, a side regulating member on the sheet loading plate and a torsion spring to generate an elastic biasing force, so as to bias the sheet loading plate to bring the uppermost sheet into contact with the sheet feeding means. The torsion spring biases the sheet loading plate so that a torsion moment generated by the end-arm portions of the torsion spring is made variable depending on a position of other of the end-arm portions engaged with the side regulating member.

6 Claims, 10 Drawing Sheets

SHEET FEEDING PRESSURE IN THE EMBODIMENT

EXCESSIVE SHEET FEEDING PRESSURE IN SMALL-SIZE SHEET

EXCESSIVELY LOW SHEET FEEDING PRESSURE IN LARGE-SIZE SHEET

SHEET FEEDING APPARATUS WITH SHEET LIFTING MEMBER AND IMAGE FORMING APPARATUS

BACKGROUND OF THE INVENTION

1. Field of the Invention

The present invention relates to a sheet feeding apparatus for feeding a sheet and an image forming apparatus for recording image information on the fed sheet and, more specifically, to a sheet conveying apparatus which adapts a sheet feeding pressure to a sheet size or a loaded weight.

2. Description of the Related Art

In the fields of image forming apparatuses such as a copying machine, a facsimile machine, and a printer, a sheet feeding apparatus has a sheet storing device such as a sheet tray on which a sheet is loaded and which stores a sheet. A sheet loading plate on which a sheet stack is loaded and supported is arranged in the housing of the sheet storing device. A pickup roller (sheet feeding roller) is arranged above the sheet loading plate such that the pickup roller is brought into contact with the uppermost sheet. The sheet loading plate is biased by a biasing spring lifts up the sheet stack to press the uppermost sheet against the pickup roller. In this case, a force of pressing the sheet stack against the pickup roller is called a sheet feeding pressure hereinafter. When a rotating power is transmitted to the pickup roller, a rotation frictional force of the roller and a bias spring force from the lower side generate a sheet feeding pressure. In this manner, the uppermost sheets are sequentially fed and conveyed to the image formation device.

As a known means which generates a sheet feeding pressure, in addition to a biasing spring, a structure in which a lifting mechanism constituted by a drive motor and the like is moves upwardly to lift a sheet loading plate to a position at a level of a conveyance path level to bring a pickup roller into press contact with the uppermost sheet by a spring is known.

Since the structure which obtains the sheet feeding pressure by a biasing spring is simple and inexpensive, the structure is often used in the field of a low-speed-processing image forming apparatus having a sheet tray and a sheet cassette in which a capacity of loaded sheets is 25 or less. On the other hand, in the latter structure in which a sheet feeding pressure is obtained by a lifting mechanism, a constant sheet feeding pressure can be always obtained regardless of a sheet live load, and a large number of sheets can be loaded and stored. However, the number of parts increases, and a control mechanism which lifts the sheet loading plate up is required to increase the cost. For this reason, the structure is used in the field of an image forming apparatus which performs relatively high speed processing.

The sheet feeding pressure can be expressed by a value obtained by subtracting an additional value between a sheet loading weight and the weight of the sheet loading plate from a push-up force acting on the sheet loading plate. When the push-up force obtained by the biasing spring is excessively large more than necessary, so-called multi feeding easily occurs such that several sheets are conveyed by a pickup roller at once. On the other hand, when a push-up force generated by a biasing spring is small not to obtain a necessary sheet feeding pressure, the pickup roller slips on the uppermost sheet and cannot feed out the sheet to easily cause non-feeding.

In a sheet cassette which copes with a relatively small capacity of 250 loaded sheets or less, a change in weight caused by the number of sheets is small. For this reason, it is relatively easy to appropriately adjust or set a sheet feeding pressure. However, in a large-capacity sheet cassette on which 500 sheets can be loaded, the following problem occurs. A change in weight caused by the number of loaded sheets is large. Furthermore, when a so-called universal cassette which can cope with several types of sheets having different sizes is used, a difference in weight between a sheet of the maximum size and a sheet of the minimum size is so large that appropriate setting of a sheet feeding pressure is very difficult.

A sheet feeding pressure generated by using a biasing spring, as shown in a characteristic graph in FIG. 7, exhibits an almost linear characteristic from a full load condition to a feeding condition of a last sheet regardless of sheet sizes. In this case, for example, setting is performed in accordance with a sheet feeding pressure obtained in a full load condition of sheets having a maximum size, i.e., A3, a sheet feeding pressure coping with a full load condition of sheets of minimum sizes, i.e., B5R is excessively large more than necessary. As a result, when a sheet of a size B5R is sent, multi feeding easily occurs.

In contrast to this, as shown in a characteristic graph in FIG. 8, when a sheet feeding pressure is set in accordance with a full load condition of size B5R sheets, a sheet feeding pressure in a full load condition of size A3 sheets, a sheet feeding pressure in the full load condition of size A3 sheets is short to make it impossible to feed the sheets. More specifically, it is impossible to obtain a sheet feeding pressure adapting to a full load condition of sheets having different sheet sizes to a last-sheet-feeding condition by a single biasing spring having a constant spring strength (spring constant).

In order to solve the problem, for example, in Japanese Patent Application Laid-open No. 9-30663, the following configuration is proposed. For example, in Japanese Patent Application Laid-open No. 9-30663, several types of biasing springs having different spring strengths are prepared, and the spring strengths are changed in accordance with at least one biasing spring for each of the different types of sheets. Japanese Patent Application Laid-open No. 61-22647 proposes the following configuration. An inclined guide unit is arranged on the lower surface of a sheet loading plate to displace a contact portion of a spring depending on a sheet width, so that a sheet feeding pressure is kept almost constant.

However, as in an invention described in Japanese Patent Application Laid-open No. 9-30663, when several types of springs are prepared for respective sheets of different sizes, another dedicated member such as a pressure-adjusting arm must be arranged for each spring to change a spring strength depending on a sheet size. For this reason, in addition to an increase in number of parts or an increase in cost caused by preparing several types of springs, an apparatus is complicated due to the pressure-adjusting arm or the like, and management of accuracy of spring strengths becomes very difficult.

As described in Japanese Patent Application Publication No. 61-22647, when the inclination guide device is arranged on the lower surface of the sheet loading plate to change the contact portion of the biasing spring depending on sheet widths, a space for the inclination must be counted in a direction of height of the sheet cassette. As a result, the sheet cassette increases in size to increase in size of the apparatus. Since a compression coil spring is used as a biasing spring, a guide member for guiding an extension/contraction operation must be independently arranged. At the same time, a parts cost and a manufacturing cost are disadvantageously increased by an increase in number of parts.

SUMMARY OF THE INVENTION

In consideration of the above problems, it is an object of the present invention to provide an inexpensive, highly-reliable sheet feeding apparatus which can be adopted to sheet load weights changing depending on sizes, and also provide an image forming apparatus which includes the sheet feeding apparatus to make it possible to maintain total processing capability.

In order to achieve the above object, according to the present invention, there is provided a sheet feeding apparatus including: a sheet loading plate which loads and stores sheets; sheet feeding member which sends an uppermost sheet of the sheets loaded on the sheet loading plate; a side regulating member which is slidably moved depending on sizes of the sheets loaded on the sheet loading plate to regulate the sheets; and a biasing means which biases the sheet loading plate to bring the uppermost sheet of the loaded sheets into contact with the sheet feeding member, a biasing force being made variable in conjunction with slidable movement of the side regulating member, wherein the biasing means is a torsion spring to generate an elastic biasing force, one of end-arm portions of a torsion spring is brought into contact with the rear surface of the sheet loading plate, and the other is engaged with the side regulating member, so that a torsion moment generated by the end-arm portions of the torsion spring is made variable depending on a position of other of the end-arm portions engaged with the side regulating member.

DESCRIPTION OF THE EMBODIMENTS

A preferred embodiment of a sheet feeding apparatus and that of an image forming apparatus, respectively, according to the present invention will be described in detail with reference to the drawings.

Figure 1:
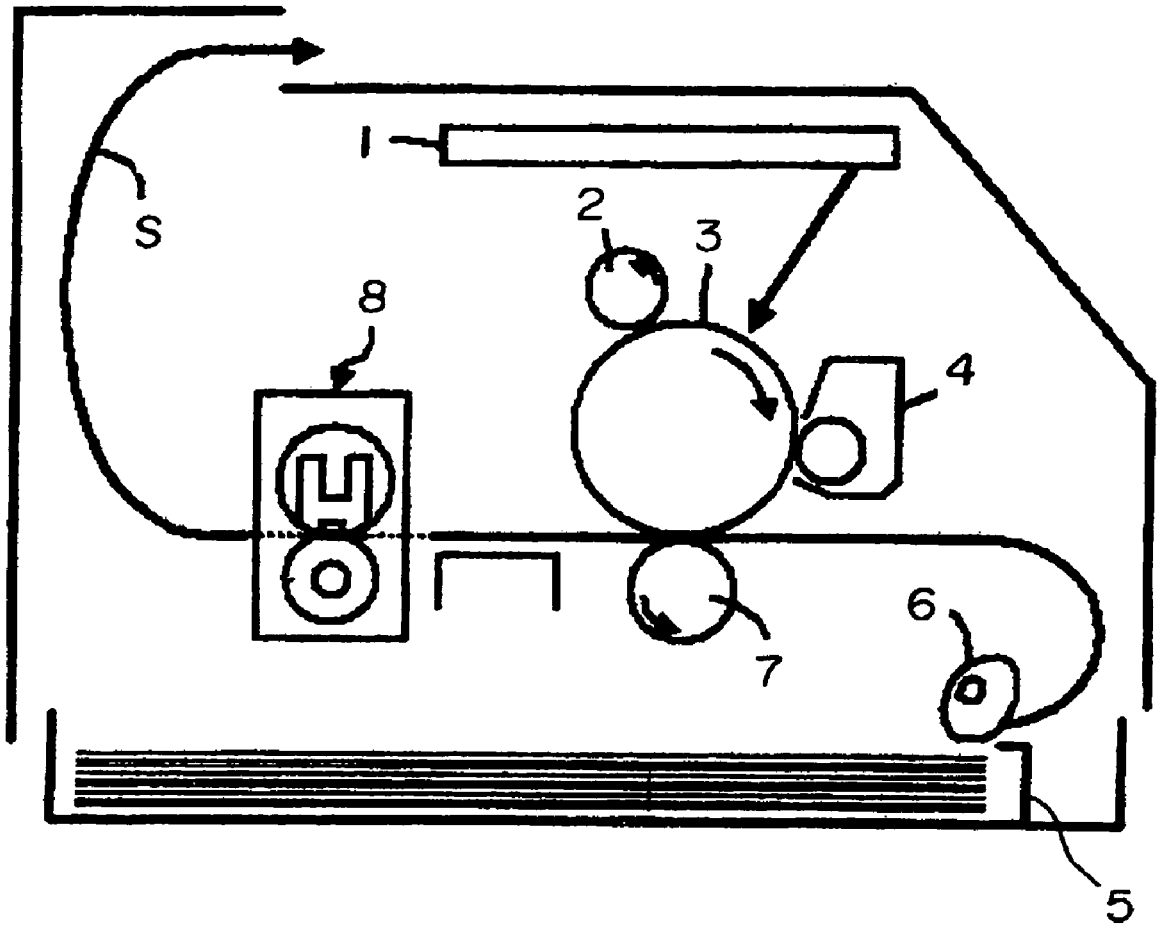
FIG. 1 is a sectional view schematically showing a laser beam printer as an embodiment of an image forming apparatus according to the present invention.

FIG. 1 shows a configuration of a laser beam printer main body obtained by an electrophotographic system as a concrete example of an image forming apparatus. An image formation device included in the laser beam printer main body is constituted by respective members and devices. A scanner 1 of an exposing means modulates an intensity of a laser beam on the basis of a signal of image information transmitted from a higher-level device such as a personal computer or a host computer, and irradiates the laser beam on a photosensitive drum 3 serving an image bearing member the surface of which is uniformly charged by a charger 2 of a charging means to form an electrostatic latent image. The electrostatic latent image is conveyed to an opposing portion between a developing device 4 and the photosensitive drum 3 with rotation of the photosensitive drum 3 in a direction of an arrow and sequentially developed by the developing device 4. The developed toner image is transferred onto recording paper sent from the sheet feeding device 5, in this case, a sheet S serving as transfer paper, by a transfer roller 6. The sheet S onto which the toner image is transferred is separated with rotation of the photosensitive drum 3 and sent to a fixing device 8 through a convey guide 7.

Figure 2:
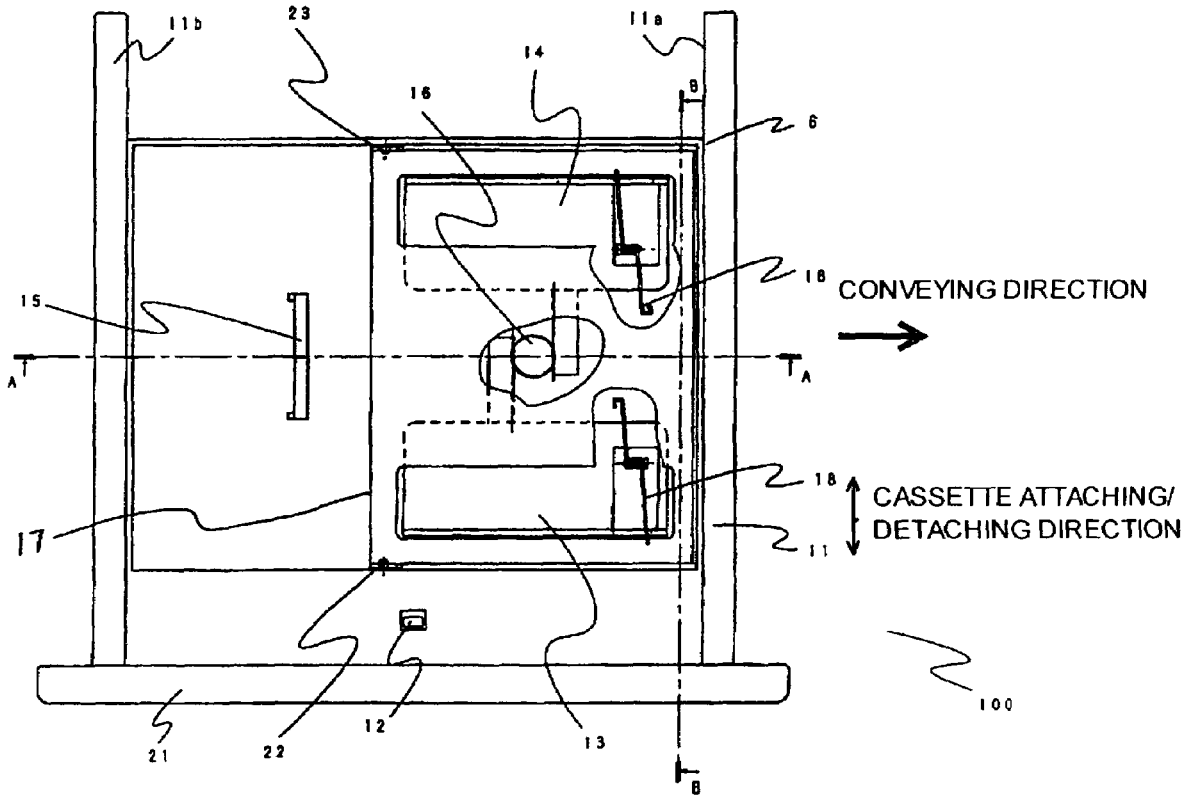
FIG. 2 is a plan view showing a sheet cassette according to the embodiment of the present invention.

As shown in FIG. 2, a sheet cassette 100 included in the sheet feeding device 5 can load approximate 500 sheets S in desired sizes thereon and store the sheets. The sheet cassette 100 is attached to or detached from the laser beam printer main body (to be referred to as a device main body hereinafter) in a direction perpendicular to a sheet conveying direction indicated by an arrow in FIG. 2. In a cassette loading state, the transfer roller 6 (see FIG. 1) arranged above a sending port of the sheet cassette 100 is rotated to sequentially feed the sheets S from the uppermost sheet S and to send the sheets to a sheet conveyance path in the apparatus main body.

The cassette main body 11 can be molded as a single unit and coupled to a cassette front cover 21 or molded integrally with the cassette front cover 21. Rail guides 11*a* and 11*b* are arranged in parallel on both the left and right sides along an attaching/detaching direction of the cassette main body 11. At the time of cassette attaching/detaching, the cassette main body is engaged with a rail (not shown) arranged on a printer main body side, so that a user grips a handle 12 to make it possible to perform a drawing operation. A sheet storing device in the cassette main body 11 has side regulating plates (regulating members) 13 and 14 which are brought into contact with both the ends of the sheet S in the direction of width to adjust the sheet end, and has a rear-end regulating plate 15 which is brought into contact with a rear end of the sheet S in a conveying direction to regulate the sheet. The side regulating plates 13 and 14 have rack portions meshed with a pinion gear 16 to make it possible to integrally move the side regulating plates 13 and 14 depending on a sheet width of the sheet S. The rear-end regulating plate 15 is arranged on the cassette main body 11 such that the rear-end regulating plate 15 can be slid in accordance with the rear end of the sheet.

A sheet loading plate 17 which supports the sheet S is arranged in the cassette main body 11, and projecting bosses 22 and 23 are formed on both end sides of the sheet loading plate 17. The sheet loading plate 17 is pivotally supported by using the bosses 22 and 23 as pivotal points of support. Furthermore, a torsion spring 18 serving as a biasing spring which generates an elastic biasing force is attached to a rear surface side (rear side) of the sheet loading plate 17 as a lift member in the present invention to bias the sheet loading plate 17 by using the bosses 22 and 23 as the pivotal points of support in a direction in which the sheet loading plate 17 is lifted in a counterclockwise direction in FIG. 3. More specifically, a stack of loaded sheet S is lift up by the spring force of the torsion spring 18 to press the uppermost sheet S against the feeding roller 6 shown in FIG. 1 from the bottom, so that a sheet feeding pressure is generated as pressing force between the sheet and the roller 6.

Figure 3:
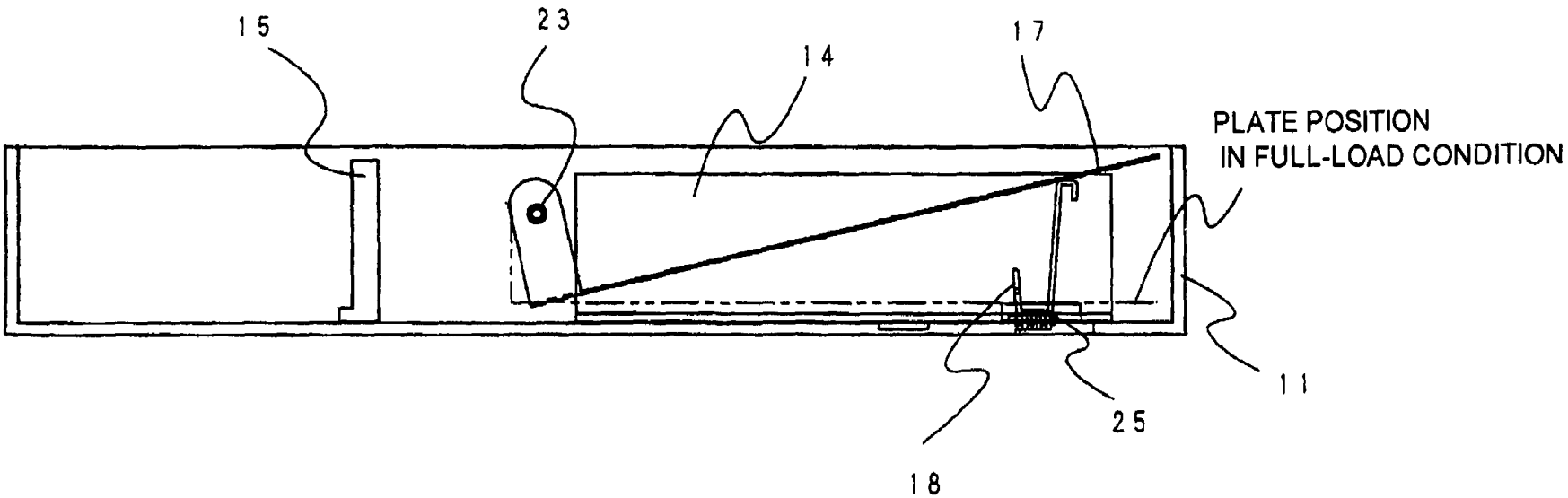
FIG. 3 is a sectional view along an arrow A-A in the sheet cassette in FIG. 2.
Figure 4A:
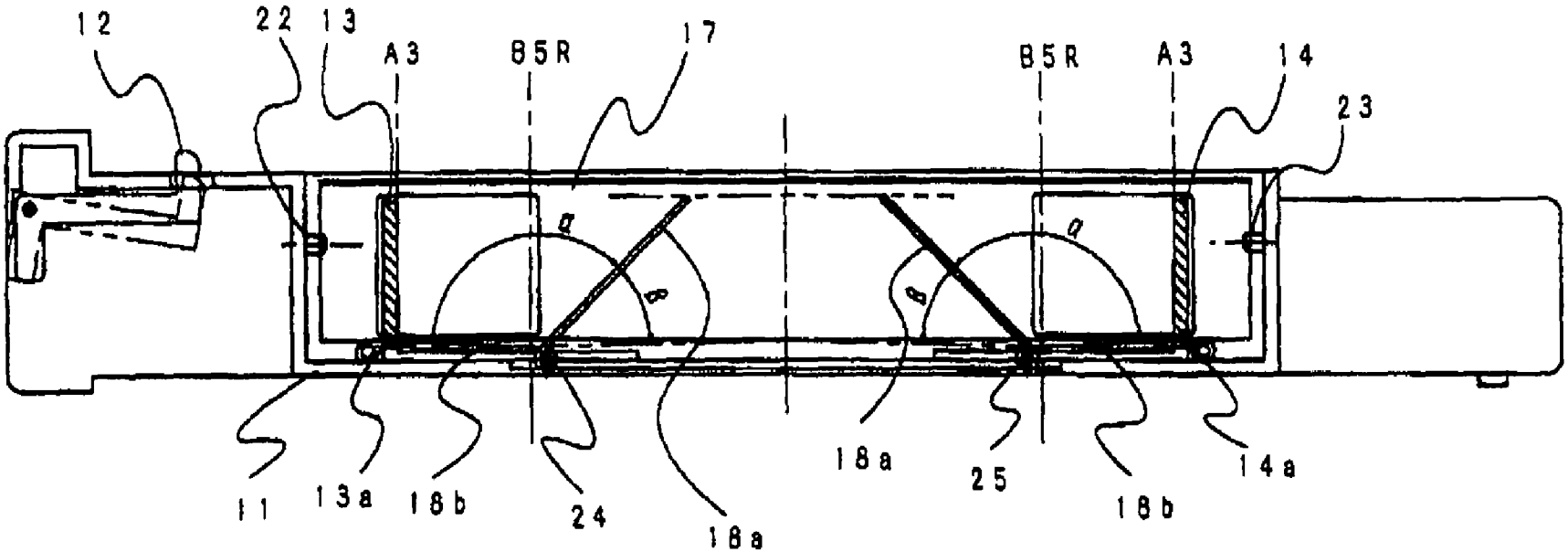
FIGS. 4A and 4B are sectional views showing, along an arrow B-B in FIG. 2, operations of a torsion spring at a last-sheet-feeding position and a full-load-condition position of sheets of maximum size, i.e., A3 stored in the sheet cassette.
Figure 4B:
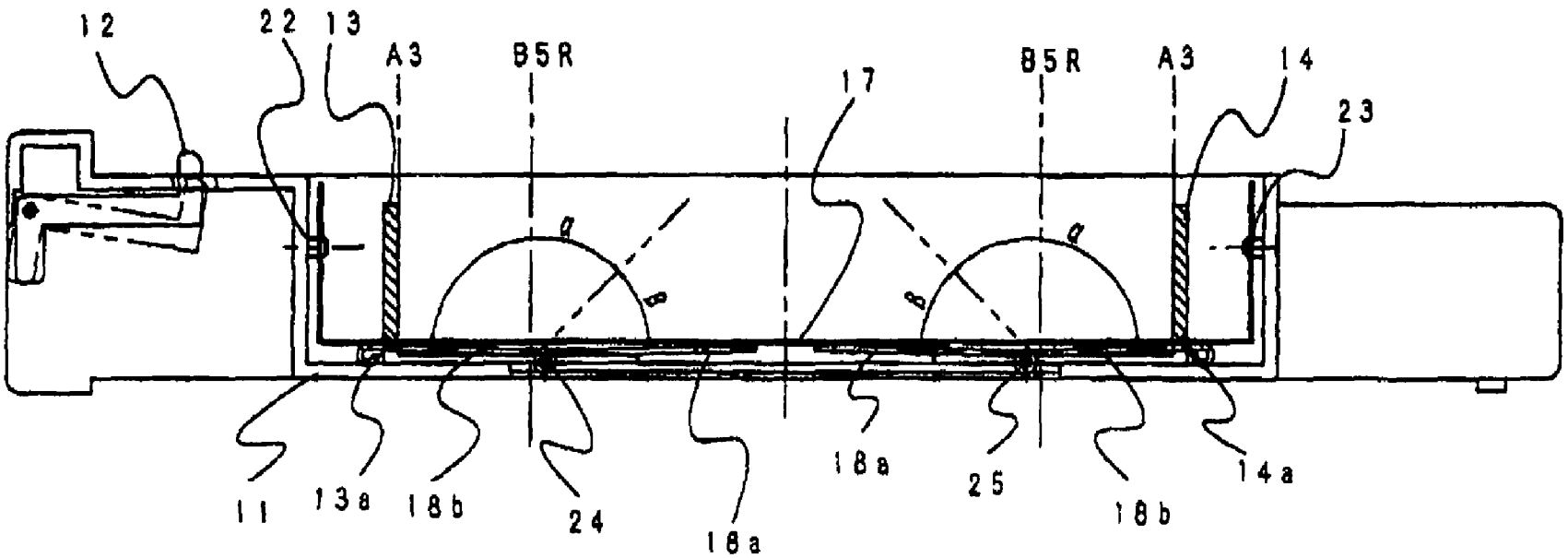

In this case, the following main-part structure is arranged on the sheet loading plate 17. As shown in FIG. 3 and FIGS. 4A and 4B which are sectional views along an arrow A-A in FIG. 1, a sheet S of maximum sheet size which can be stored in the cassette main body 11, for example, a sheet S of size A3 is set in the cassette main body 11. As the torsion spring 18, a pair of torsion springs are arranged on both the sides of the cassette in the direction of width, i.e., in the front back in the drawings. An arm portion 18*a* of the torsion spring 18 is brought into contact with the lower surface of the sheet loading plate 17 to cause push-up force to act on the lower surface, and the other arm portion 18*b* is engaged with lower ends of support surfaces 13*a* and 14*a* provided on the side regulating plates 13 and 14. A coil portion of the torsion spring 18 is held by support bosses 24 and 25 provided on the cassette main body 11 and retained by a lock member (not shown) to prevent the coil portion from dropping out.

Therefore, the following operation is performed. That is, the other arm portion 18*b* of the torsion spring 18 is regulated by the support surfaces 13*a* and 14*a* of the side regulating plates 13 and 14 and unmoved. However, one arm portion 18*a* is elastically transformed and displaced to follow a full-load position to a last-sheet-feeding position depending on a weight of loaded sheets of size A3 stored in the cassette. In this manner, a difference between torsion moments of both the arm portions 18*a* and 18*b* is used to hold a sheet feeding pressure almost constant. More specifically, a difference between torsion angles β of the arm portion 18*a* of the torsion spring 18 in a full-load condition and a last-sheet-feeding condition is used to increase the torsion angles β and a push-up force in a full-load condition having a high load and to decrease the torsion angles β and the push-up force in a last-sheet-feeding condition having a low load, so that an almost uniform sheet feeding pressure is generated depending on a change in weight of loaded sheets from the full-load condition to the last-sheet-feeding condition.

Figure 5A:
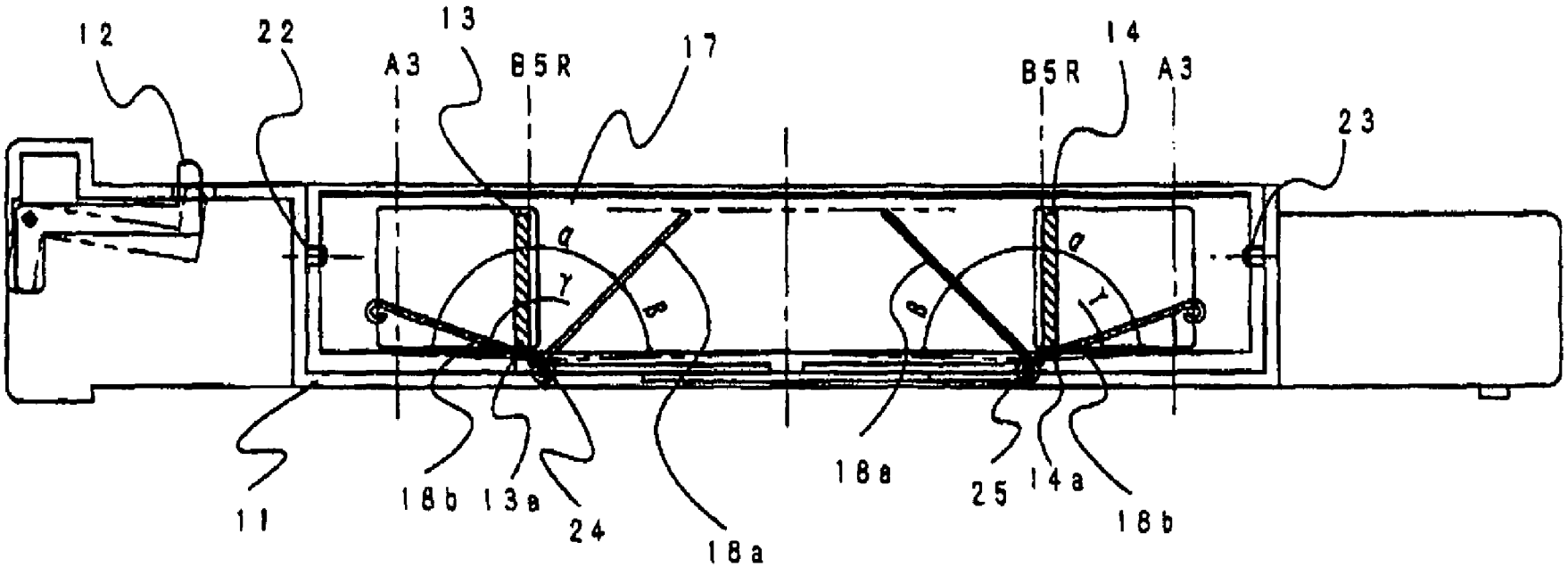
FIGS. 5A and 5B are sectional views showing, along an arrow B-B in FIG. 2, operations of a torsion spring at a last-sheet-feeding position and a full-load-condition position of sheets of minimum size, i.e., B5R stored in the sheet cassette.
Figure 5B:
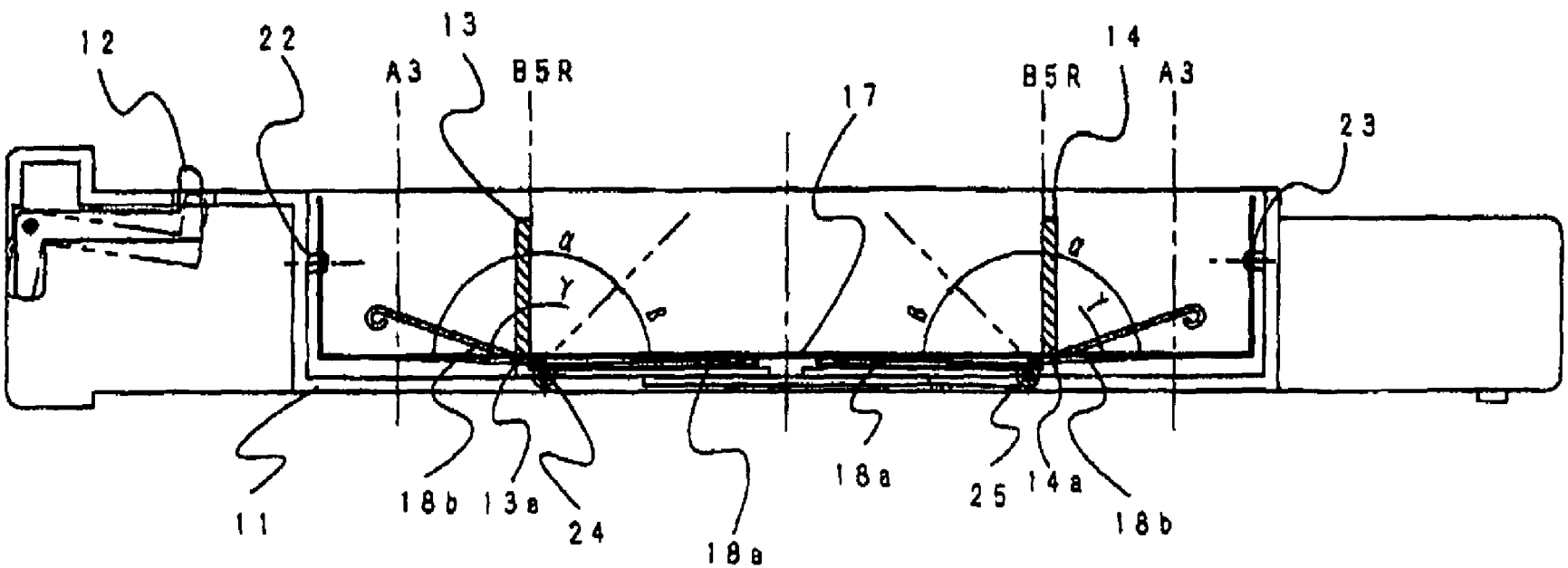

FIGS. 5A and 5B show a state in which sheets S of minimum sheet sizes, i.e., size B5R, which can be stored in the cassette main body 11 are set. FIG. 5A shows a set state in a last-sheet-feeding condition, and FIG. 5B shows a set state in a full-load condition.

In accordance with the sheet of size B5R to be stored, both the side regulating plates 13 and 14 are moved in a direction to decrease the interval between both the plates to bring the side regulating plates 13 and 14 into contact with both the ends of the sheet so as to regulate the sheet width of the sheet S. When the side regulating plates 13 and 14 is slidably moved in the direction to decrease the interval, in accordance with the movement, the other arm portion 18*b* of the torsion spring 18 engaged with the lower ends of the support surfaces 13*a* and 14*a* rises up from a size-A3 position by an angle y and pivotally displaced. The torsion angle decreases by the rising of the arm portion 18*b* to decrease the torsion moment. Therefore, the torsion moment obtained by the torsion spring 18 is changed from the maximum value to the minimum value depending on a change from a weight of loaded sheets of a maximum size, i.e., size A3 to a weight of loaded sheets of a minimum size, i.e., size B5R.

When the interval between the side regulating plates 13 and 14 is only adjusted to increase or decrease depending on a sheet size without increasing the number of parts, the sheet feeding pressure can be made constant. More specifically, torsion angles of the arm portions 18 and 18*b* of the torsion spring 18 are relatively changed in conjunction with adjustment of movement of the side regulating plates 13 and 14. An elastic force is decreased when a sheet of a small size is used, and the elastic force is increased when a sheet of a large size is used. Even though weights of sheets change depending on different sheet sizes or even though weights of loaded sheets change by decreasing the number of sheets by sheet feeding, an appropriate sheet feeding pressure can be generated. As in the conventional structure, when a strike plate of a biasing spring is formed aslope, a space for a height of inclination in a direction of height of the cassette need not be counted. For this reason, the sheet cassette 100 can be reduced in size, and, consequently, the image forming apparatus main body can be advantageously reduced in size.

Figure 6:
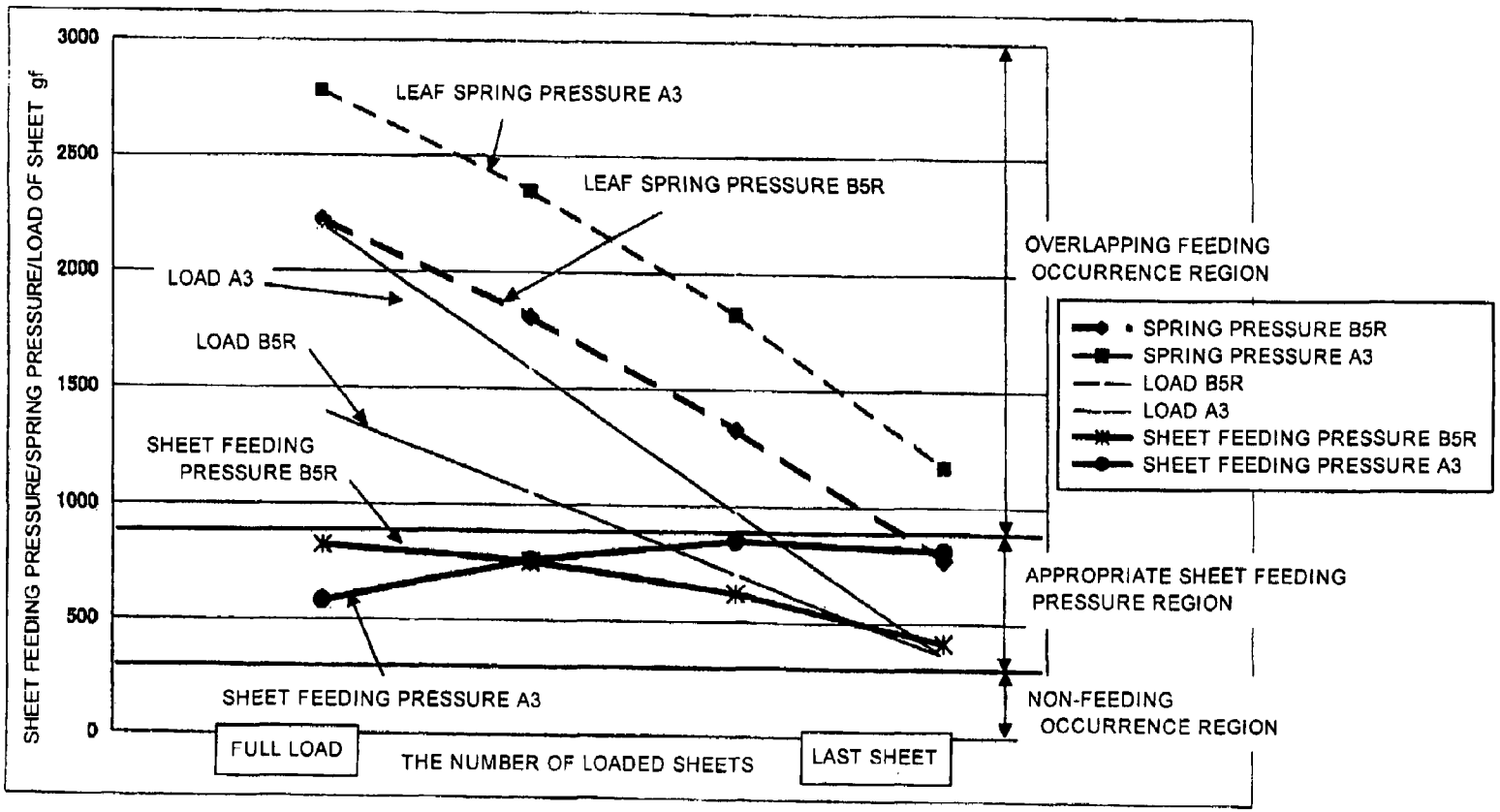
FIG. 6 is a characteristic graph showing an appropriate sheet feeding pressure region and a multi feeding occurrence region in correlation between (a sheet feeding pressure)/(a spring pressure (spring constant))/(a sheet live load) in a period from a full load condition to a last-sheet-feeding condition of sheets of sizes A3 and B5R stored in the sheet cassette.
Figure 7:
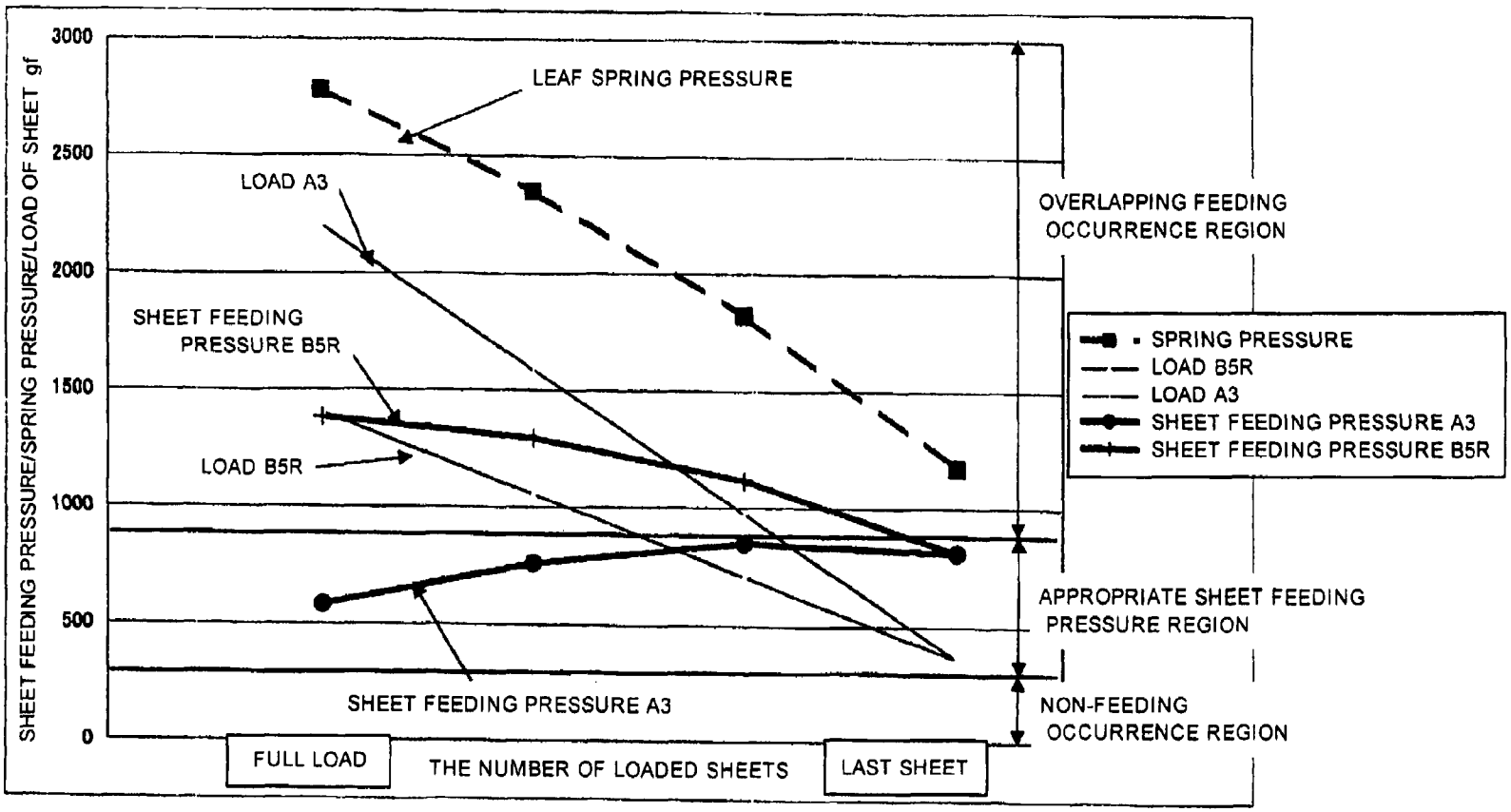
FIG. 7 is a characteristic graph showing a state in which a sheet feeding pressure is excessively high when small-size sheets are stored in a conventional art.
Figure 8:
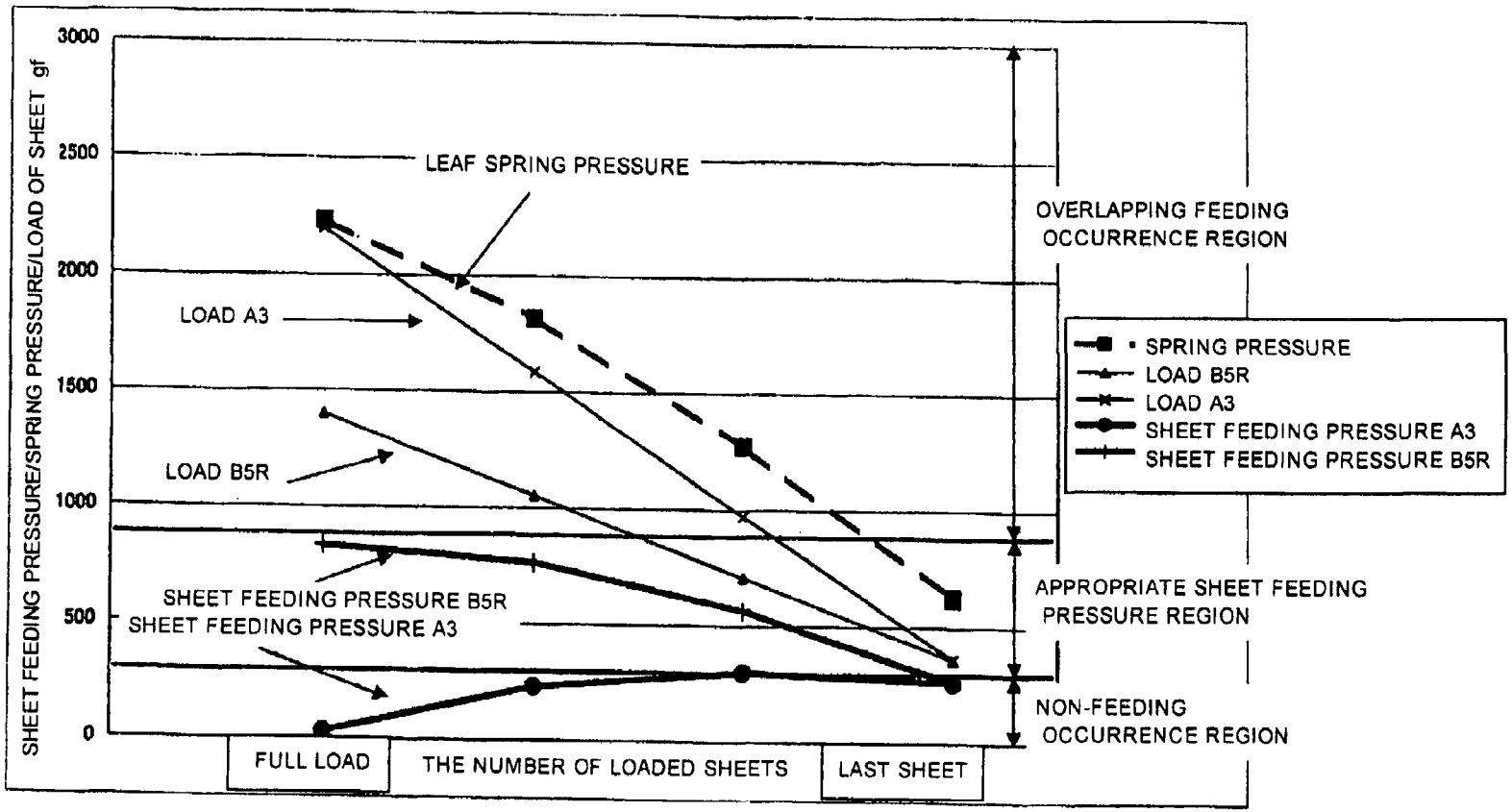
FIG. 8 is a characteristic graph showing a state in which a sheet feeding pressure is excessively low when large-size sheets are stored in the conventional art.

FIG. 6 is a characteristic graph showing transition of a sheet feeding pressure from a full-load condition to a last-sheet-feeding condition with respect to sheets S having a maximum size, i.e., size A3 and a minimum size, i.e., size B5R in the sheet feeding apparatus, for example. As is apparent from the graph, the sheet feeding pressure falls within an appropriate sheet feeding pressure range in an entire region from the full-load condition to the last-sheet-feeding condition of the number of loaded sheets having size A3 and size B5R. Even though sheets S of other sizes, e.g., size B4 and size A4 are stored, an appropriate sheet feeding pressure can be similarly satisfied. A sheet feeding pressure obtained by using the torsion spring 18 can be calculate from the following arithmetic expressions:

$$L=\pi DN+(m+n)/3 \tag{1}$$

$$\phi=ML/EI=64\mathrm{ML}/\pi Ed^4 \tag{2}$$

$$Kt=M/\phi \tag{3}$$

$$\sigma=32\mathrm{M}/\pi d^3 \tag{4}$$

$$M=P_1R_1=P_2R_2 \tag{5}$$

In the above expressions, d; wire diameter of spring material, D; average diameter of coil, N; winding number, E; vertical elastic coefficient, M; torsion moment acting on torsion spring, L; significant developed length of torsion spring, m, n; lengths of arms, φ; torsion angle of torsion spring, Kt; torsion spring constant, σ; bending stress, P1; force acting on one arm portion of torsion spring, P2: force acting on other arm portion of torsion spring, R1; distance from center of torsion spring to working point of one arm portion, and R2; distance from center of torsion spring to acting point of other arm portion From these parameters, a sheet feeding pressure Q is calculated by the following expression:

$$Q=P_1z-W \tag{6}$$

In expression (6), reference symbol $P_1z$ denotes a vertical component of force which acts one of the arm portions (arm portion 18*a* in this embodiment), and reference symbol W is a load on a sheet loading plate (added value of a weight of loaded sheets and a weight of the sheet loading plate).

In the embodiment, as the material of the torsion spring 18, stainless steel (SUS304-WPB) or the like can be used. When the parameters in the above expressions are set as follows, the sheet feeding pressure Q can be set within an appropriate sheet feeding pressure Q=400 to 850 [gf] regardless of sheet sizes and the number of loaded sheets, for example, 0 to 500 sheets. Therefore, since the number of parts does not increase and the mechanism is not complicated, a low cost and a stable sheet feeding pressure can be compatible, and a sheet cassette having a capacity of 500 sheets of a maximum sheet size and using a push-up system can be realized. As a result, the apparatus can be reduced in size, and a highly reliable sheet feeding apparatus can be provided.

More specifically, in order to obtain the effect, in the sheet feeding apparatus according to the embodiment, unlike in conventional art, without using a complex mechanism and various types of spring members, a sheet feeding pressure is made almost constant such that a torsion angle of the torsion spring 18 is decreased in use of a sheet S of a small size and the torsion angle is increased in use of a sheet S of a small size. For this reason, the present invention makes substantial contributions to reductions in size and cost of the apparatus and improvement in reliability of the apparatus by stabilizing the pressure.

As shown in FIG. 1, in the image forming apparatus such as a laser beam printer including a sheet feeding apparatus which makes it possible to stably convey sheets, sheets are reliably conveyed one by one from the sheet feeding apparatus with an appropriate sheet feeding pressure depending on a sheet size. For this reason, a total processing capability of recording an image on a stably conveyed sheet by an image formation device can be maintained without causing defective conveyance such as multi feeding or non-feeding or jam (paper jam).

The present invention is not limited to the above embodiment. Other embodiments can be effected without departing from the spirit and scope of the invention, and applications and modifications obtained by combining the embodiments are also effected.

This application claims the benefit of priority from the prior Japanese Patent Application No. 2005-152148 filed on May 25, 2005 the entire contents of which are incorporated by reference herein.

What is claimed is:

1. A sheet feeding apparatus comprising:

a sheet loading plate which supports sheets;

a sheet feeding member which sends an uppermost sheet of the sheets supported by the sheet loading plate;

a side regulating member which is slidably moved in a direction perpendicular to a sheet feeding direction by the sheet feeding member depending on sizes of the sheets supported by the sheet loading plate to regulate the sheets by contacting with a side edge of the sheet in a direction of the sheet width; and a torsion spring which is disposed so that an axis thereof is in a direction parallel to the sheet feeding direction, and a first arm portion of the torsion spring is brought into contact with a rear surface of the sheet loading plate, and a second arm portion of the torsion spring is engaged with the side regulating member, and the torsion spring generates an elastic biasing force so as to bias the sheet loading plate to bring the uppermost sheet of the supported sheets into contact with the sheet feeding member, wherein the second arm portion is engaged with the side regulating member so that a torsion angle between the first arm portion and the second arm portion is changed as an engaged position of the second arm portion engaged with the side regulating member is changed, and the torsion spring biases the sheet loading plate by varied elastic biasing forces which are made depending on the change of the torsion angle.

2. The sheet feeding apparatus according to claim 1, wherein the torsion moment changes depending on sheet sizes of sheet regulated by said side regulating plate such that the torsion moment is maximum when the regulating member regulates a sheet having a maximum width of a sheet which can be supported on the sheet loading plate and the torsion moment is minimum when the regulating member regulates a sheet having a minimum width.

3. The sheet feeding apparatus according to claim 1, wherein the side regulating member slidably moves to change positions where the side regulating member is engaged with the second arm portion of the torsion spring to change a torsion angle between the first and second arm portions of the torsion spring so as to make the torsion moment variable.

4. An image forming apparatus comprising:

a sheet loading plate which supports sheets;

a sheet feeding member which sends an uppermost sheet of the sheets supported by the sheet loading plate;

a side regulating member which is slidably moved in a direction perpendicular to a sheet feeding direction by the sheet feeding member depending on sizes of the sheets supported by the sheet loading plate to regulate the sheets by contacting with a side edge of the sheet in a direction of the sheet width;

a torsion spring which is disposed so that an axis thereof is in a direction perpendicular to the sheet feeding direction, and a first arm portion of the torsion spring is brought into contact with a rear surface of the sheet loading plate, and a second arm portion of the torsion spring is engaged with the side regulating member, and the torsion spring generates an elastic biasing force so as to bias the sheet loading plate to bring the uppermost sheet of the supported sheets into contact with the sheet feeding member, wherein the second arm portion is engaged with the side regulating member so that a torsion angle between the first arm portion and the second arm portion is changed as an engaged position of the second arm portion engaged with the side regulating member is changed, and the torsion spring biases the sheet loading plate by a varied elastic biasing forces which are made depending on the change of the torsion angle based on a difference of the engaged position; and an image formation device which forms an image on a sheet feed out by said sheet feeding member.

5. The image forming apparatus according to claim 4, wherein the torsion moment changes depending on sheet sizes of sheet regulated by said side regulating plate such that the torsion moment is maximum when the regulating member regulates a sheet having a maximum width of a sheet which can be supported on the sheet loading plate and the torsion moment is minimum when the regulating member regulates a sheet having a minimum width.

6. The image forming apparatus according to claim 4, wherein the side regulating member slidably moves to change positions where the side regulating member is engaged with the second arm portion of the torsion spring to change a torsion angle between the first and second arm portions of the torsion spring so as to make the torsion moment variable.

* * * * *